US010641202B2

(12) United States Patent
Nakazono

(10) Patent No.: US 10,641,202 B2
(45) Date of Patent: May 5, 2020

(54) CYLINDER HEAD

(71) Applicant: TOYOTA JIDOSHA KABUSHIKI KAISHA, Toyota-shi (JP)

(72) Inventor: Takaaki Nakazono, Nagakute (JP)

(73) Assignee: TOYOTA JIDOSHA KABUSHIKI KAISHA, Toyota-shi (JP)

( * ) Notice: Subject to any disclaimer, the term of this patent is extended or adjusted under 35 U.S.C. 154(b) by 0 days.

(21) Appl. No.: 16/196,712

(22) Filed: Nov. 20, 2018

(65) Prior Publication Data

US 2019/0170085 A1 Jun. 6, 2019

(30) Foreign Application Priority Data

Dec. 4, 2017 (JP) ..... 2017-232647

(51) Int. Cl.

*F01L 1/053* (2006.01)
*F02F 1/24* (2006.01)
*F02F 7/00* (2006.01)

(52) U.S. Cl.

CPC ..... *F02F 7/006* (2013.01); *F01L 1/053* (2013.01); *F02F 1/24* (2013.01); *F02F 7/008* (2013.01);

(Continued)

(58) Field of Classification Search

CPC ..... F01L 1/053; F01L 1/0532; F01L 1/143; F01L 1/185; F01L 2001/0535; F01L 2001/0537; F01L 2001/34496; F01L 2810/03; F01L 2810/04; F02F 1/24; F02F 1/38; F02F 7/006; F02F 7/008; F02F 2007/0063; F01M 9/11; F01M 9/102; F02B 2275/18; F02B 77/11; F02B 77/13

(Continued)

(56) References Cited

U.S. PATENT DOCUMENTS 4,438,734 A * 3/1984 Hayashi ..... F01L 1/053 123/193.5
4,467,754 A * 8/1984 Hayashi ..... F02F 1/108 123/195 C (Continued)

FOREIGN PATENT DOCUMENTS

DE 10339308 A1 * 3/2005 ..... F02B 77/11
DE 10 2014 002 767 A1 8/2015

(Continued)

*Primary Examiner* — Jacob M Amick
*Assistant Examiner* — Michael A Kessler
(74) *Attorney, Agent, or Firm* — Oblon, McClelland, Maier & Neustadt, L.L.P.

(57) ABSTRACT

A camshaft housing includes two longitudinal frame bars and lateral frame bars. The longitudinal frame bars extend in the axial direction of a camshaft. The lateral frame bars extend between the longitudinal frame bars. A bearing portion is arranged in each of the lateral frame bars to rotationally support the camshaft. Each lateral frame bar has a bolt hole to receive a bolt that is inserted through the bolt hole to fix the camshaft housing to a cylinder head body. The bolt hole extends through the lateral frame bar and is arranged on the outer side of the bearing portion in the longitudinal direction of the lateral frame bar. Each longitudinal frame bar has a vibration reducing portion. The cross-sectional area of the longitudinal frame bar gradually changes in the longitudinal direction of the longitudinal frame bar.

5 Claims, 4 Drawing Sheets

(52) U.S. Cl.
CPC ... *F01L 2001/0537* (2013.01); *F01L 2101/00* (2013.01); *F01L 2810/03* (2013.01); *F01L 2810/04* (2013.01); *F02B 2275/18* (2013.01); *F02F 2007/0063* (2013.01)

(58) Field of Classification Search
USPC ..... 123/90.27, 90.6, 193.5, 90.38, 90.17, 123/195 H, 192.1
See application file for complete search history.

(56) References Cited

U.S. PATENT DOCUMENTS 4,823,747 A * 4/1989 Wagner ..... F01L 1/0532 123/193.5
5,150,675 A * 9/1992 Murata ..... F01L 1/18 123/193.5
5,901,680 A * 5/1999 Ozeki ..... F02F 7/0007 123/195 H
6,679,220 B2 * 1/2004 Shiraishi ..... F02B 75/20 123/195 R
2003/0015164 A1 * 1/2003 Cho ..... F01M 11/0004 123/195 H
2004/0149267 A1 8/2004 Takahashi et al.
2004/0182354 A1 * 9/2004 Ueno ..... F02F 1/38 129/193.5
2004/0190807 A1 * 9/2004 Iijima ..... F01L 1/0532 384/462
2007/0240671 A1 * 10/2007 Imazato ..... F01L 1/053 123/193.5
2009/0013949 A1 * 1/2009 Kumagai ..... F01L 1/053 123/90.38
2009/0320784 A1 * 12/2009 Shoji ..... F01L 1/053 123/193.5
2016/0177867 A1 * 6/2016 Wicks ..... F01M 9/10 123/90.38
2016/0177868 A1 * 6/2016 Wicks ..... F02F 7/006 123/90.6
2017/0254230 A1 * 9/2017 Madin ..... F01L 1/143
2018/0320562 A1 * 11/2018 Hirukawa ..... F02F 1/24
2018/0355770 A1 * 12/2018 Fluharty ..... F01L 1/18

FOREIGN PATENT DOCUMENTS

DE 102014002767 A1 * 8/2015
EP 1 441 122 A1 7/2004
EP 1674703 A2 * 6/2006 ..... F02F 7/0053
JP 11-247710 A 9/1999
JP 2008-57427 3/2008
KR 2004102685 A * 12/2004 ..... F02F 1/24
WO WO 2017/082131 A1 5/2017

* cited by examiner

CYLINDER HEAD

BACKGROUND

The present disclosure relates to a cylinder head.

Japanese Laid-Open Patent Publication No. 2008-57427 discloses a cylinder head adapted for arrangement on the upper side of a cylinder block. The cylinder head includes a cylinder head body and a camshaft housing. The cylinder head body is fixed to the upper surface of the cylinder block. The camshaft housing is fixed to the upper surface of the cylinder head body. Camshafts are accommodated in the camshaft housing and selectively open and close the intake valves and the exhaust valves.

The camshaft housing described in the aforementioned document includes two longitudinal frame bars extending in the axial direction of the camshafts. Multiple lateral frame bars extend between the longitudinal frame bars. The lateral frame bars are spaced apart at equal intervals in the axial direction of the camshafts. The lateral frame bars are arranged such that each adjacent two of the lateral frame bars are parallel to each other. A section recessed downward in a semi-circular shape is provided in the upper surface of each of the lateral frame bars as a bearing portion. Each of the bearing portions rotationally supports one of the camshafts. Bolt holes are provided at the opposite ends in the longitudinal direction of each lateral frame bar. The bolt holes extend through the lateral frame bars in the up-down direction. Bolts are inserted through the bolt holes and fix the camshaft housing to the cylinder head body.

Vibration is caused by driving an internal combustion engine or operating the vehicle and transmitted to the cylinder head. The frequency of the vibration transmitted to the cylinder head may coincide with the natural frequency of the longitudinal frame bars or the lateral frame bars, thus causing resonance in the longitudinal or lateral frame bars. Such resonance in the cylinder head may cause noise or damage and thus is undesirable.

SUMMARY

In accordance with one aspect of the present disclosure, a cylinder head is provided that includes a cylinder head body fixed to an upper surface of a cylinder block and a camshaft housing fixed to an upper surface of the cylinder head body. A camshaft is accommodated in the camshaft housing. The camshaft housing includes two longitudinal frame bars, which extend in an axial direction of the camshaft and a plurality of lateral frame bars, which extend between the longitudinal frame bars. A bearing portion is arranged in an upper surface of each of the lateral frame bars to rotationally support the camshaft. Each of the bearing portions is a portion recessed from the upper surface of one of the lateral frame bars. A bolt hole is provided in each lateral frame bar to receive a bolt that is inserted through the bolt hole to fix the camshaft housing to the cylinder head body. Each of the bolt holes extends through one of the lateral frame bars and is arranged on an outer side of the corresponding bearing portion in a longitudinal direction of the lateral frame bar. The longitudinal frame bars each have a plurality of joint points at which the longitudinal frame bar is joined to the corresponding lateral frame bar. Each longitudinal frame bar includes, between adjacent two of the joint points, a vibration reducing portion, wherein a cross-sectional area of a cross section of the vibration reducing portion that is perpendicular to a longitudinal direction of the longitudinal frame bar gradually changes in the longitudinal direction of the longitudinal frame bar.

Other aspects and advantages of the present disclosure will become apparent from the following description, taken in conjunction with the accompanying drawings, illustrating exemplary embodiments.

BRIEF DESCRIPTION OF THE DRAWINGS

The disclosure may be understood by reference to the following description together with the accompanying drawings.

DETAILED DESCRIPTION

A cylinder head 10 according to one embodiment will now be described with reference to the drawings.

Figure 1:
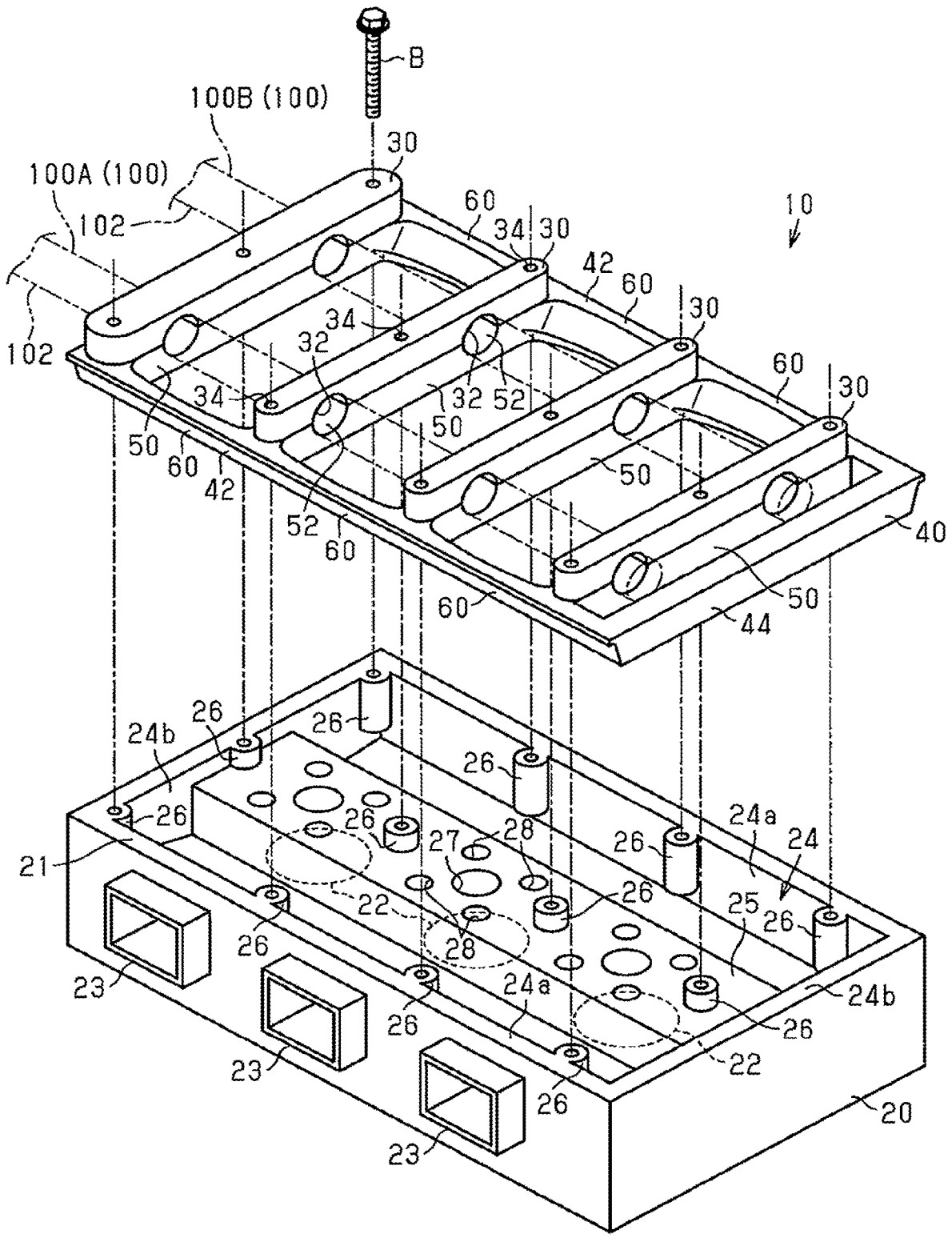
FIG. 1 is an exploded perspective view of a cylinder head.

As shown in FIG. 1, the cylinder head 10 includes a cylinder head body 20 and a camshaft housing 40. The cylinder head body 20 is fixed to the upper surface of a non-illustrated cylinder block. The camshaft housing 40 is fixed to the upper surface of the cylinder head body 20. Non-illustrated intake valves and non-illustrated exhaust valves are mounted in the cylinder head body 20. Camshafts 100 are accommodated in the camshaft housing 40 to selectively open and close the intake and exhaust valves. The camshafts 100 rotate as the crankshaft rotates. FIG. 1 schematically shows the camshafts 100 using the long dashed double-short dashed lines.

Figure 3:
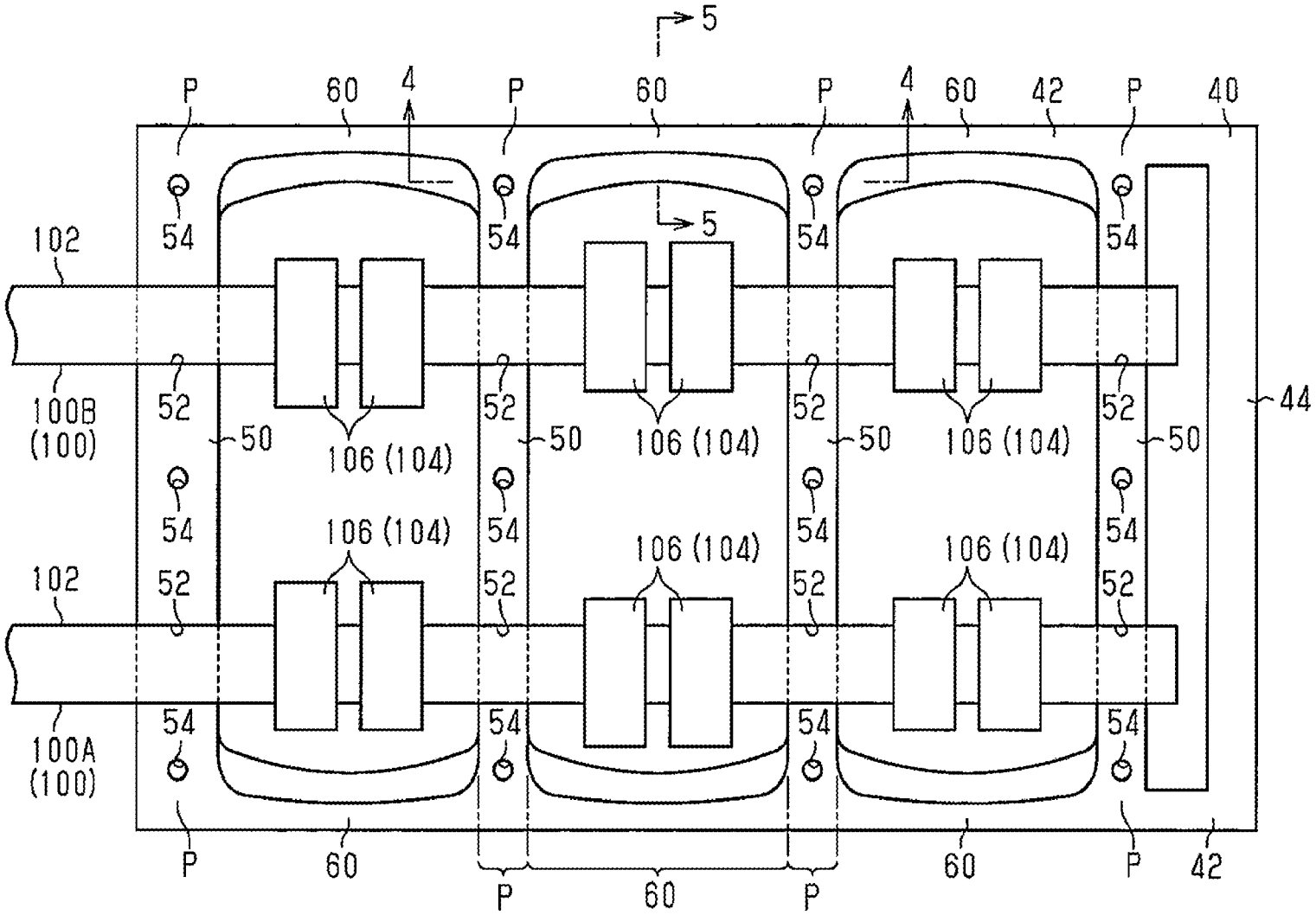
FIG. 3 is a top view of the camshaft housing and camshafts.

With reference to FIGS. 1 and 3, each of the camshafts 100 includes a tubular shaft body 102 and three cam piece sets 104. The cam piece sets 104 are fixed to the shaft body 102 and spaced apart at equal intervals. Each of the cam piece sets 104 is constituted by two cam pieces 106. Each of the cam pieces 106 is shaped substantially like an elliptical plate. The two cam pieces 106 are opposed to each other in the thickness direction of the cam pieces 106. Each of the shaft bodies 102 extends through the cam pieces 106 of the associated three of the cam piece sets 104 in the thickness direction. Each of the cam pieces 106 converts the rotation of the shaft body 102 into linear movement and transmits the linear movement to the exhaust or intake valves. The two camshafts 100 are arranged parallel to each other on the cylinder head body 20. One of the camshafts 100 is an intake camshaft 100A for operating the intake valves, and the other is an exhaust camshaft 100B for operating the exhaust valves.

As illustrated in FIG. 1, the cylinder head body 20, as a whole, is shaped like a rectangular parallelepiped. Three combustion chambers 22 are arranged in the lower surface of the cylinder head body 20. Each of the combustion chambers 22 is a section recessed upward from the lower surface of the cylinder head body 20. Each combustion chamber 22 has a circular shape as viewed from above. The combustion chambers 22 are aligned and spaced apart at equal intervals in the longitudinal direction of the cylinder head body 20, or in the axial direction of the camshafts 100. The combustion chambers 22 are each arranged in the middle in the transverse direction of the cylinder head body 20. When the cylinder head body 20 is attached to the cylinder block, the combustion chambers 22 are opposed to the cylinders defined in the cylinder block. FIG. 1 shows the openings of the combustion chambers 22 using broken lines.

The cylinder head body 20 has two longitudinal side surfaces extending in the longitudinal direction of the cylinder head body 20 and two transverse side surfaces extending in the transverse direction of the cylinder head body 20. Three intake ports 23 project from one of the longitudinal side surfaces of the cylinder head body 20 and are each shaped substantially like a rectangular tube. The intake ports 23 are aligned and spaced apart at equal intervals in the longitudinal direction of the cylinder head body 20. The intake ports 23 extend to the combustion chambers 22 in the cylinder head body 20. This configuration supplies atmospheric air into the combustion chambers 22 via the intake ports 23. Exhaust ports project from the other longitudinal surface of the cylinder head body 20 opposite to the intake ports 23. The exhaust ports are each shaped in the same manner as the intake ports 23. Exhaust gas is discharged from the combustion chambers 22 through the exhaust ports.

A recess 24 is provided in the upper surface of the cylinder head body 20 and has a rectangular shape as viewed from above. The upper section of the cylinder head body 20 is shaped like a rectangular frame and has two longitudinal wall sections 24*a* extending in the longitudinal direction and two transverse wall sections 24*b* extending in the transverse direction. The upper end surfaces of the longitudinal wall sections 24*a* and the upper end surfaces of the transverse wall sections 24*b* configure an upper end surface 21 of the cylinder head body 20. A mounting structure portion 25 is arranged in the recess 24 and extends in the longitudinal direction of the cylinder head body 20. The mounting structure portion 25 extends from the inner surface of one of the transverse wall sections 24*b* to the inner surface of the other. Also, the mounting structure portion 25 is arranged in the middle in the transverse direction of the cylinder head body 20. The mounting structure portion 25 is arranged above the combustion chambers 22.

The mounting structure portion 25 has plug mounting holes 27. Spark plugs are mounted in the respective plug mounting holes 27 to cause ignition in the combustion chambers 22. The plug mounting holes 27 extend through the mounting structure portion 25 in the up-down direction. The mounting structure portion 25 also has valve mounting holes 28. The intake and exhaust valves are mounted in the valve mounting holes 28. The valve mounting holes 28 extend through the mounting structure portion 25 substantially in the up-down direction. The lower ends of the plug mounting holes 27 and the lower ends of the valve mounting holes 28 are open in the combustion chambers 22. One of the plug mounting holes 27 and four of the valve mounting holes 28 are provided for each of the combustion chambers 22. Specifically, the one plug mounting hole 27 and four valve mounting holes 28 constitute a group. Three such groups are provided in correspondence with the three combustion chambers 22. In FIG. 1, only a single group of the plug mounting hole 27 and the valve mounting holes 28 is given reference numerals.

Four cylindrical boss portions 26 project upward from the upper surface of the mounting structure portion 25. Bolts are inserted through the respective boss portions 26. Each of the boss portions 26 has an axis extending in the up-down direction. The upper surface of each boss portion 26 is flush with the upper end surfaces of the longitudinal wall sections 24*a* and the upper end surfaces of the transverse wall sections 24*b*. The four boss portions 26 of the mounting structure portion 25 are spaced apart at equal intervals in the longitudinal direction of the cylinder head body 20. These boss portions 26 are arranged in the middle in the transverse direction of the cylinder head body 20.

Also, the inner surfaces of the longitudinal wall sections 24*a* each have four cylindrical boss portions 26. Each of these boss portions 26 has an axis extending in the up-down direction. The upper surfaces of the boss portions 26 are flush with the upper end surfaces of the longitudinal wall sections 24*a* and the upper end surfaces of the transverse wall sections 24*b*. In each of the longitudinal wall sections 24*a*, the boss portions 26 are spaced apart at equal intervals in the longitudinal direction of the cylinder head body 20. As viewed in the transverse direction of the cylinder head body 20, the positions of the boss portions 26 in the longitudinal wall sections 24*a* coincide with the positions of the boss portions 26 in the mounting structure portion 25. In other words, any two of the boss portions 26 of the longitudinal wall sections 24*a* and one of the boss portions 26 of the mounting structure portion 25 are aligned on a common line extending in the transverse direction of the cylinder head body 20.

Figure 2:
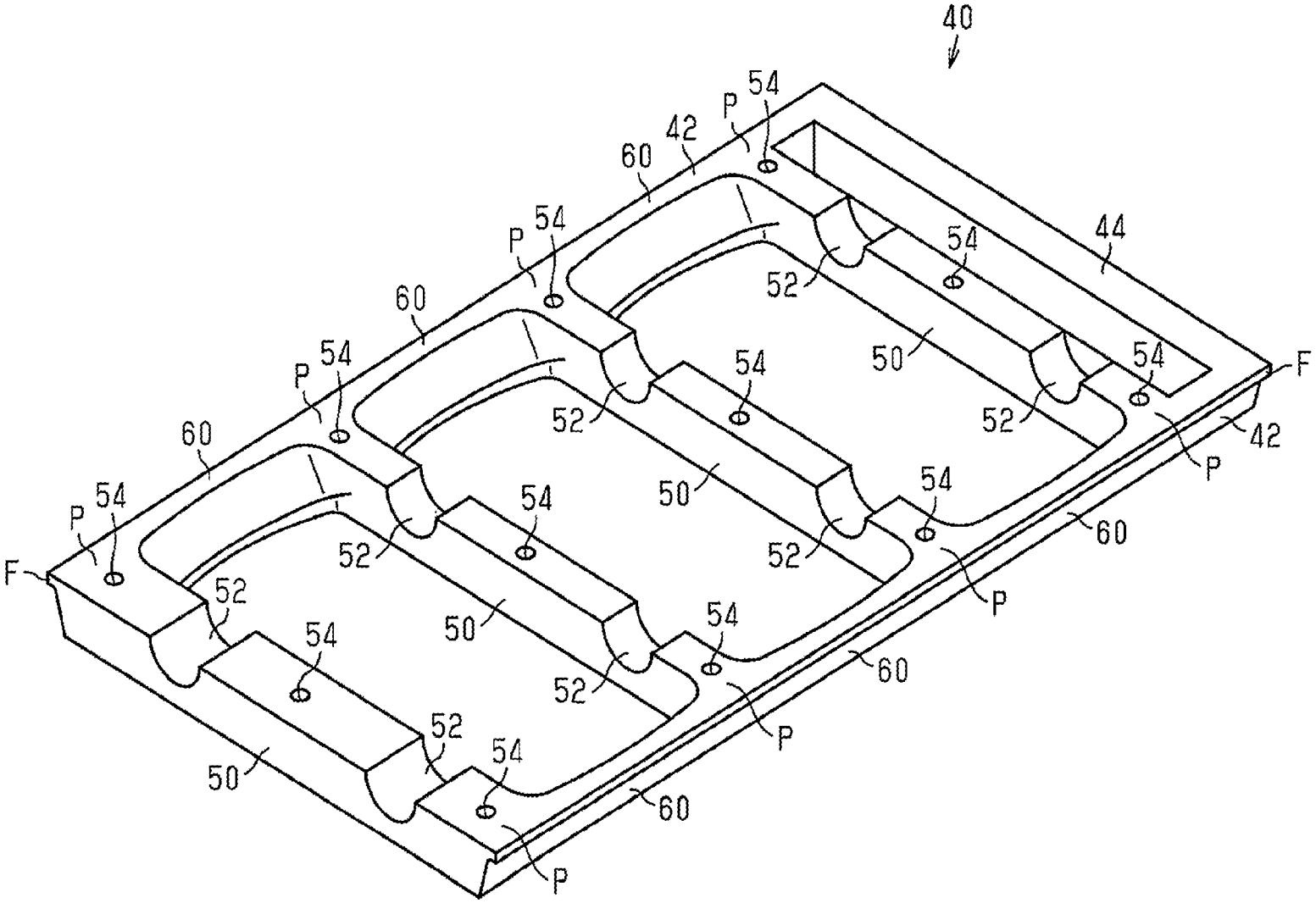
FIG. 2 is a perspective view of a camshaft housing.

As illustrated in FIGS. 2 and 3, the camshaft housing 40 includes two longitudinal frame bars 42 extending parallel to each other. Four lateral frame bars 50 and an outer frame bar 44 extend between the longitudinal frame bars 42. The lateral frame bars 50 and the outer frame bar 44 each extend in a direction perpendicular to the longitudinal directions of the longitudinal frame bars 42.

The dimension of the outer frame bar 44 in the up-down direction is equal to both the dimension of the lateral frame bars 50 and the dimension of the longitudinal frame bars 42 in the up-down direction. The upper surface of the outer frame bar 44 is thus flush with the upper surfaces of the lateral frame bars 50 and the upper surfaces of the longitudinal frame bars 42. Also, the lower surface of the outer frame bar 44 is flush with the lower surfaces of the lateral frame bars 50 and the lower surfaces of the longitudinal frame bars 42.

One of the lateral frame bars 50 that is close to the ends in the longitudinal direction of the longitudinal frame bars 42 extend to connect these ends to each other. The four lateral frame bars 50 are aligned and spaced apart substantially at equal intervals in the longitudinal directions of the longitudinal frame bars 42. Each of the lateral frame bars 50 is arranged above the corresponding three of the boss portions 26 that are aligned in the transverse direction of the cylinder head body 20. The outer frame bar 44 is arranged close to the other longitudinal ends of the longitudinal frame bars 42. The distance between the outer frame bar 44 and the adjacent one of the lateral frame bars 50 is smaller than the distance between any adjacent two of the lateral frame bars 50.

The outer frame bar 44 extends to connect the corresponding longitudinal ends of the longitudinal frame bars 42 to each other. The outer frame bar 44, the one of the lateral frame bars 50 that is located opposite to the outer frame bar 44, and the two longitudinal frame bars 42 form a rectangular frame. The outer peripheral dimension of this frame is substantially equal to the outer peripheral dimension of the cylinder head body 20.

As shown in FIG. 2, an upper end section of each longitudinal frame bar 42 has an outwardly extended, flange-shaped overhang F. Each of the overhangs F is arranged in the full longitudinal range in the associated one of the longitudinal frame bars 42.

With reference to FIGS. 1 to 3, the upper surface of each lateral frame bar 50 has semi-circular bearing portions 52. Each of the bearing portions 52 is a portion recessed downward from the upper surface of the lateral frame bar 50. The bearing portions 52 are arranged one by one on the opposite sides of the middle in the longitudinal direction of each lateral frame bar 50. In FIG. 1, only some of the bearing portions 52 are given reference numerals.

As illustrated in FIGS. 2 and 3, three bolt holes 54 extend through each lateral frame bar 50 in the up-down direction. One of the three bolt holes 54 is arranged between the two bearing portions 52. The other two bolt holes 54 are arranged one by one each on the outer side of the bearing portion 52 in the longitudinal direction of the lateral frame bar 50. The bolt hole 54 between the bearing portions 52 is arranged substantially in the middle in the longitudinal direction of the lateral frame bar 50. The axis of this bolt hole 54 coincides with the axis of the corresponding boss portion 26 of the mounting structure portion 25. On the other hand, each of the bolt holes 54 located on the outer side of the bearing portion 52 in the longitudinal direction of the lateral frame bar 50 is arranged in the vicinity of the joint point between the lateral frame bar 50 and the corresponding longitudinal frame bar 42. The axis of each of these bolt holes 54 coincides with the axis of the boss portion 26 in the corresponding longitudinal wall section 24*a*.

As illustrated in FIG. 1, the lower surface of the camshaft housing 40, which is shaped like a frame, contacts an upper end surface 21 of the cylinder head body 20 through a liquid gasket. Specifically, the lower surface of each longitudinal frame bar 42 contacts the upper end surface of the corresponding longitudinal wall section 24*a*. The lower surface of the outer frame bar 44 and the lower surface of the lateral frame bar 50 located opposite to the outer frame bar 44 contact the upper end surfaces of the corresponding transverse wall sections 24*b*. The liquid gasket is solidified in a state in which the cylinder head 10 has the camshaft housing 40 fixed to the cylinder head body 20.

With reference to FIG. 1, a bar-shaped cam cap 30 is fixed to the upper surface of each lateral frame bar 50 and extends in the longitudinal direction of the lateral frame bar 50. The length and width of each of the cam caps 30 are substantially equal to the length and width of each of the lateral frame bars 50. The lower surface of each cam cap 30 has semi-circular bearing portions 32. Each of the bearing portions 32 is a section recessed upward from the lower surface of the one of the cam caps 30. The bearing portions 32 are arranged one by one on opposite sides of the middle in the longitudinal direction of each cam cap 30. The bearing portions 32 are opposed to the bearing portions 52 of the corresponding lateral frame bar 50. In FIG. 1, only some of the bearing portions 32 of the cam caps 30 are given reference numerals.

The shaft body 102 of the intake camshaft 100A and the shaft body 102 of the exhaust camshaft 100B are rotationally supported between the bearing portions 52 of the lateral frame bars 50 and the bearing portions 32 of the cam caps 30. Specifically, the shaft body 102 of the intake camshaft 100A is sandwiched between the bearing portions 52 located close to one longitudinal ends of the lateral frame bars 50 and the bearing portions 32 of the cam caps 30. The shaft body 102 of the exhaust camshaft 100B is sandwiched between the bearing portions 52 located close to the other longitudinal ends of the lateral frame bars 50 and the bearing portions 32 of the cam caps 30. Referring to FIG. 3, the cam pieces 106 of the intake camshaft 100A or the exhaust camshaft 100B are each arranged between two of the lateral frame bars 50 that are adjacent to each other. In both the intake camshaft 100A and the exhaust camshaft 100B, an end of the shaft body 102 is arranged between the outer frame bar 44 and the adjacent lateral frame bar 50. The other end of the shaft body 102 is arranged outside the camshaft housing 40.

As shown in FIG. 1, three cap bolt holes 34 extend through each cam cap 30 in the up-down direction. One of the three cap bolt holes 34 is arranged between the two bearing portions 32. The other two of the cap bolt holes 34 are arranged side by side each on the outer side of the corresponding bearing portion 32 in the longitudinal direction of the cam cap 30. In FIG. 1, only some of the cap bolt holes 34 of the cam caps 30 are given reference numerals.

Figure 4:
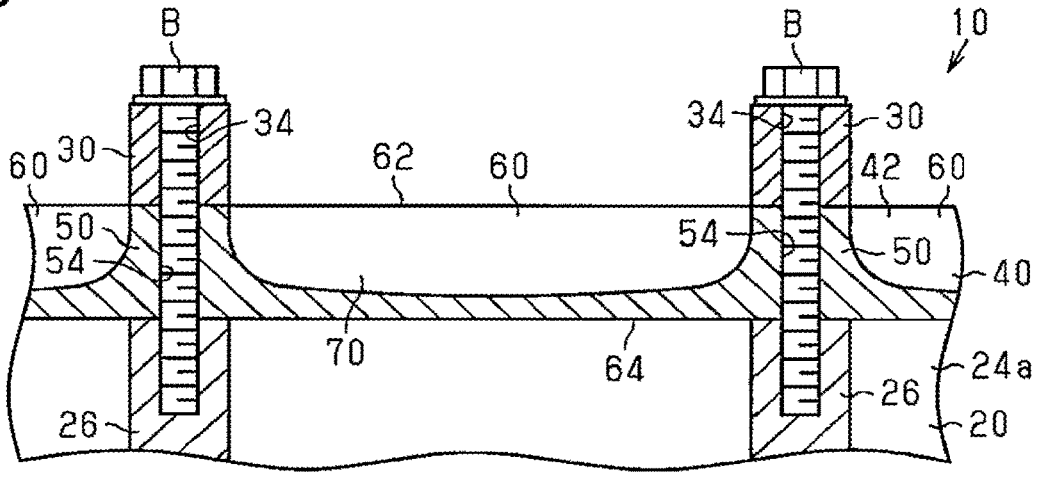
FIG. 4 is a partial cross-sectional view taken along line 4-4 of FIG. 3.

With reference to FIGS. 1 and 4, the axis of the cap bolt hole 34 close to the end of each cam cap 30 coincides with the axis of the bolt hole 54 close to the end of the associated lateral frame bar 50 and the axis of the corresponding boss portion 26 in the longitudinal wall section 24*a* of the cylinder head body 20. Bolts B are passed through the cap bolt holes 34 from above. The bolts B are then passed through the bolt holes 54 of the lateral frame bars 50 and fastened to the boss portions 26 of the cylinder head body 20.

The axis of each cap bolt hole 34 between the associated bearing portions 32 coincides with the axis of the middle one of the bolt holes 54 of the associated lateral frame bar 50 and the axis of the corresponding boss portion 26 of the mounting structure portion 25 of the cylinder head body 20. The bolts B are passed through the cap bolt holes 34 from above. The bolts B are then passed through the bolt holes 54 of the lateral frame bars 50 and fastened to the boss portions 26 of the cylinder head body 20. The bolts B thus fix the cam caps 30, the camshaft housing 40, and the cylinder head body 20 integrally with one another. FIG. 1 shows only one of the bolts B.

As shown in FIG. 3, each longitudinal frame bar 42 has four joint points P with respect to the lateral frame bars 50. Each of the joint points P is a section of the longitudinal frame bar 42 corresponding to the width of the lateral frame bar 50. Each longitudinal frame bar 42 has vibration reducing portions 60 to reduce vibration in the longitudinal frame bar 42. Each of the vibration reducing portions 60 extends over the entire area between the corresponding adjacent two of the joint points P.

Figure 5:
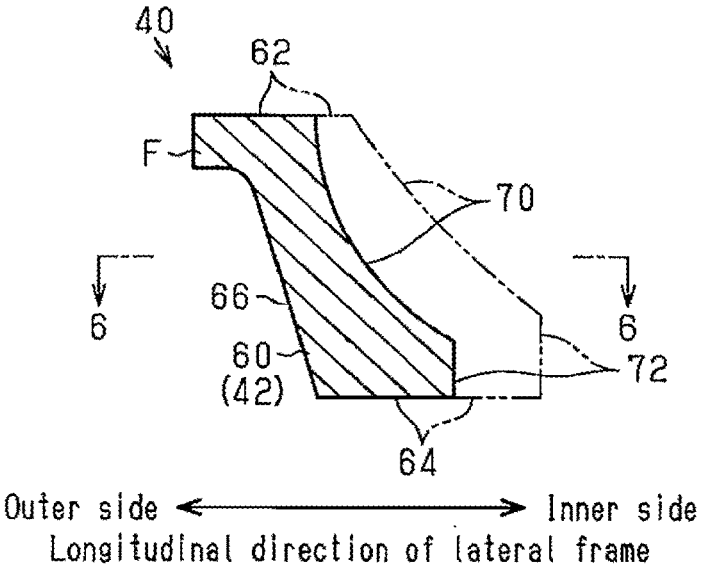
FIG. 5 is a partial cross-sectional view taken along line 5-5 of FIG. 3.

FIG. 5 shows a cross section of each longitudinal frame bar 42 perpendicular to the longitudinal direction of the longitudinal frame bar 42 (hereinafter, referred to as the perpendicular cross section). As schematically shown in FIG. 5, the outline of each vibration reducing portion 60 is shaped like a polygonal post. The vibration reducing portion 60 includes a flat outer upper surface 62. The outer upper surface 62 is arranged close to the end of the corresponding lateral frame bar 50 and faces upward. The outer section of the outer upper surface 62 in the longitudinal direction of the lateral frame bar 50 configures the upper surface of the overhang F. An arcuate inner upper surface 70 extends from the inner edge of the outer upper surface 62 in the longitudinal direction of the lateral frame bar 50. The inner upper surface 70 becomes curved more downward toward the inner side in the longitudinal direction of the lateral frame bar 50. A flat inward-facing surface 72 extends downward from the lower edge of the inner upper surface 70 and faces inward in the longitudinal direction of the lateral frame bar 50. A flat lower surface 64 extends from the lower edge of the inward-facing surface 72 toward the outer side in the longitudinal direction of the lateral frame bar 50. The edge of the lower surface 64 on the outer side in the longitudinal direction of the lateral frame bar 50 is arranged on the inner side of the edge of the outer upper surface 62 on the outer side in the longitudinal direction of the lateral frame bar 50. An outward-facing surface 66 extends from the edge of the lower surface 64 on the outer side in the longitudinal direction of the lateral frame bar 50. The outward-facing surface 66 extends more upward toward the outer side in the longitudinal direction of the lateral frame bar 50. The upper end of the outward-facing surface 66 is thus arranged on the outer side of the other sections of the outward-facing surface 66 in the longitudinal direction of the lateral frame bar 50. The upper end section of the outward-facing surface 66 configures the outer side surface of the overhang F.

FIG. 4 shows a cross section of the vibration reducing portion 60 as viewed from the inner side in the longitudinal direction of the lateral frame bar 50 (hereinafter, referred to as the inner cross section). Referring to FIG. 4, the inner upper surface 70 is an arcuate curved surface. The inner upper surface 70 becomes recessed more downward toward the middle between the corresponding two adjacent joint points P. The long dashed double-short dashed lines in FIG. 5 show the outline of the vibration reducing portion 60 in the vicinity of one of the corresponding joint points P. In FIG. 5, the section of the inner upper surface 70 in the middle between the corresponding two adjacent joint points P is shown with the solid line. The section of the inner upper surface 70 in the vicinity of each joint point P is shown with the long dashed double-short dashed lines. As viewed from a common position in the longitudinal direction of the lateral frame bar 50, the section of the inner upper surface 70 in the middle between the corresponding two adjacent joint points P is arranged lower than the section of the inner upper surface 70 in the vicinity of each joint point P.

Figure 6:
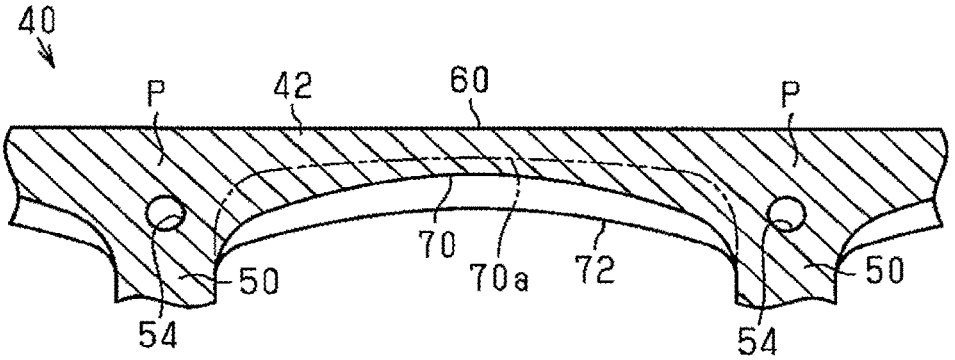
FIG. 6 is a partial cross-sectional view taken along line 6-6 of FIG. 5.

FIG. 6 shows a cross section of the vibration reducing portion 60 as viewed from above (hereinafter, referred to as the upper cross section). As shown in FIG. 6, the inner upper surface 70 is an arcuate curved surface. The inner upper surface 70 becomes recessed more outward in the longitudinal direction of the lateral frame bar 50 toward the middle between the corresponding two adjacent joint points P. In the drawing, the long dashed double-short dashed line shows the position of an edge 70*a* of the inner upper surface 70 on the outer side in the longitudinal direction of the lateral frame bar 50. The upper section of the inner upper surface 70 is recessed outward in the longitudinal direction of the lateral frame bar 50 with respect to the lower section of the inner upper surface 70. As shown in FIG. 5, as viewed along the perpendicular cross section, the section of the inner upper surface 70 in the middle between the corresponding two adjacent joint points P (represented by the solid line) is arranged on the outer side of the section of the inner upper surface 70 in the vicinity of each joint point P (represented by the long dashed double-short dashed line) in the longitudinal direction of the lateral frame bar 50. In these manners, the inner upper surface 70 becomes recessed more downward and more outward in the longitudinal direction of the lateral frame bar 50 toward the middle between the corresponding two adjacent joint points P.

With reference to FIG. 6, as viewed along the upper cross section, the inward-facing surface 72 is an arcuate curved surface. The inward-facing surface 72 becomes recessed more outward in the longitudinal direction of the lateral frame bar 50 toward the middle between the corresponding two adjacent joint points P. Referring to FIG. 5, as viewed along the perpendicular cross section, the section of the inward-facing surface 72 in the middle between the corresponding two adjacent joint points P (represented by the solid line) is arranged on the outer side of the section of the inward-facing surface 72 in the vicinity of each joint point P (represented by the long dashed double-short dashed line) in the longitudinal direction of the lateral frame bar 50.

With reference to FIG. 5, the area of the perpendicular cross section of the vibration reducing portion 60 gradually changes in the longitudinal direction of the longitudinal frame bar 42. Specifically, the area of the perpendicular cross section of the vibration reducing portion 60 gradually becomes smaller from one of the corresponding two adjacent joint points P to the middle between the joint points P and is the smallest in the middle between the joint points P.

The cylinder head body 20, the camshaft housing 40, and the cam cap 30 are all made of a common material. These components are formed using aluminum alloy. The aluminum alloy is an alloy having aluminum as its main element, such as corrosion-resistant aluminum, duralumin, super duralumin, or extra super duralumin.

An operation and advantages of the present embodiment will now be described.

(1) The camshaft housing 40 is configured by the longitudinal frame bars 42, the outer frame bar 44, and the lateral frame bars 50. The outer frame bar 44 and the lateral frame bars 50 each have a comparatively small length. Further, the outer frame bar 44 and the lateral frame bars 50 are fixed to the cylinder head body 20 through the bolts B and thus do not bend easily. In contrast, the longitudinal frame bars 42 are longer than the outer frame bar 44 and the lateral frame bars 50. Also, the longitudinal frame bars 42 are not directly fixed to the cylinder head body 20 with the bolts B. As a result, when the cylinder head 10 receives vibration, the longitudinal frame bars 42 may vibrate in a bending manner.

The longitudinal frame bars 42 are joined to the lateral frame bars 50. Thus, the joint points P of the longitudinal frame bars 42 joined to the lateral frame bars 50 is relatively unlikely to vibrate. However, each section of each longitudinal frame bar 42 in the middle between any adjacent two of the joint points P readily vibrates. In other words, the joint point P between the longitudinal frame bars 42 and the lateral frame bars 50 tends to be a node of vibration, while each section in the middle between two adjacent joint points P tends to be an antinode of vibration. If the natural frequency of such vibration in the longitudinal frame bars 42 coincides with the frequency of the vibration transmitted from the exterior of the camshaft housing 40, the longitudinal frame bars 42 may resonate and vibrate to an excessively great extent.

In the present embodiment, the entire area between any adjacent two of the joint points P in each longitudinal frame bar 42 is the vibration reducing portion 60. The cross-sectional area of each vibration reducing portion 60 gradually changes in the longitudinal direction of the longitudinal frame bar 42. The vibration reducing portion 60 thus does not have a definite natural frequency, so that resonance is unlikely to occur. Also, since the entire area between any adjacent two of the joint points P in the longitudinal frame bars 42 is the vibration reducing portion 60, resonance is unlikely to occur over the entire area between the adjacent two joint points P.

Specifically, the inner upper surface 70 of each vibration reducing portion 60 is an arcuate curved surface that becomes recessed more downward toward the middle between the adjacent two of the joint points P. Since the inner upper surface 70 is shaped in this manner, the vibration reducing portion 60 does not have a definite natural frequency regarding vibration in the up-down direction. The resonance of the vibration reducing portion 60 is thus unlikely to occur in response to the vibration in the up-down direction. Also, the inner upper surface 70 of the vibration reducing portion 60 is an arcuate curved surface that becomes recessed more outward in the longitudinal direction of the lateral frame bar 50 toward the middle between the two adjacent joint points P. Since the inner upper surface 70 is shaped in this manner, the vibration reducing portion 60 does not have a definite natural frequency regarding vibration in the longitudinal direction of the lateral frame bar 50. The resonance of the vibration reducing portion 60 is unlikely to occur in response to the vibration in the longitudinal direction of the lateral frame bar 50. Further, the inward-facing surface 72 of the vibration reducing portion 60 is an arcuate curved surface that becomes recessed more outward in the longitudinal direction of the lateral frame bar 50 toward the middle between the corresponding two adjacent joint points P. Since the inward-facing surface 72 is shaped in this manner, the vibration reducing portion 60 does not have a definite natural frequency regarding vibration in the longitudinal direction of the lateral frame bar 50. The resonance of the vibration reducing portion 60 is unlikely to occur in response to the vibration in the longitudinal direction of the lateral frame bar 50.

The inner upper surface 70 and the inward-facing surface 72 are both a curved surface that extends continuously in the entire area between the corresponding two adjacent joint points P. The inner upper surface 70 and the inward-facing surface 72 thus both lack a corner section. Therefore, each vibration reducing portion 60 does not vibrate from a corner section as a starting point.

Further, the overhang F is arranged in the full longitudinal range in each longitudinal frame bar 42 and improves the strength of the longitudinal frame bar 42 against bending. This reduces vibration in the vibration reducing portions 60.

(2) The resonance of each longitudinal frame bar 42 is reduced in the entire area between any adjacent two of the joint points P. This makes it unnecessary to employ excessively large-sized highly rigid longitudinal frame bars in order to reduce such resonance. Also, each section of each longitudinal frame bar 42 in the middle between any adjacent two of the joint points P is a section on which the fastening force of the corresponding bolt B is unlikely to act. Therefore, even if each middle section between the corresponding two adjacent joint points P has a small cross-sectional area, sufficient strength is ensured in the longitudinal frame bar 42. This allows any adjacent two of the joint points P in each longitudinal frame bar 42 to have a small cross-sectional area compared to a case in which the cross-sectional area of the longitudinal frame bar 42 is equal to the cross-sectional area in the vicinity of each joint point P and is uniform in the longitudinal direction of the longitudinal frame bar 42. As a result, the camshaft housing 40 has a small volume, which reduces the weight of the camshaft housing 40.

(3) The cylinder head 10 may be heated and thus cause thermal expansion of the camshaft housing 40 and the cylinder head body 20. In this case, there may be a difference between the amount of expansion of the camshaft housing 40 and that of the cylinder head body 20. This may rupture the solidified liquid gasket, so that necessary sealing performance cannot be obtained.

In the above-described configuration, the camshaft housing 40 is made of the same material as the cylinder head body 20. The coefficient of thermal expansion of the camshaft housing 40 is thus equal to that of the cylinder head body 20. Therefore, as long as the temperature of the camshaft housing 40 is equal to that of the cylinder head body 20, the camshaft housing 40 and the cylinder head body 20 expand substantially by equal amounts. Also, in each section of each longitudinal frame bar 42 in the middle between any adjacent two of the joint points P, the cross-sectional area of the longitudinal frame bar 42 is small and the volume of the longitudinal frame bar 42 is relatively small. The longitudinal frame bar 42 is thus easily heated by the heat transmitted from the cylinder head body 20 and the heat in the engine compartment. As a result, the temperature difference between each longitudinal frame bar 42 and the cylinder head body 20 becomes small. Correspondingly, the difference between the expansion amount of the camshaft housing 40 and that of the cylinder head body 20 becomes small.

The present embodiment may be modified as follows. The above-described embodiments and the following modifications can be combined as long as the combined modifications remain technically consistent with each other.

The shape of each vibration reducing portion 60 may be changed as needed as long as the condition is met that the area of the perpendicular cross section of the vibration reducing portion 60 gradually changes in the longitudinal direction of the associated longitudinal frame bar 42. For example, if the inner upper surface 70 is an arcuate curved surface, the position at which the inner upper surface 70 is maximally recessed in the longitudinal direction of the lateral frame bar, as viewed along the upper cross section, may be set at a position spaced from the middle between the corresponding two adjacent joint points P. Also, the inward-facing surface 72 may be configured in the same manner as the inner upper surface 70.

As long as the aforementioned condition is satisfied, the inner upper surface 70 and the inward-facing surface 72 may be flat surfaces. As viewed along the upper cross section, each inner upper surface 70 may be recessed in a V shape outward in the longitudinal direction of the associated lateral frame bar 50 between the corresponding two adjacent joint points P. The inward-facing surface 72 may be configured in the same manner as the inner upper surface 70.

The inner upper surface 70 and the inward-facing surface 72 may each have a shape that has a curved surface and a flat surface combined together. Only one of the inner upper surface 70 and the inward-facing surface 72 may be recessed and the other one of the inner upper surface 70 and the inward-facing surface 72 may be formed without being recessed. Also, as long as the aforementioned condition is satisfied, the shapes of the sections of each vibration reducing portion 60 other than the inner upper surface 70 and the inward-facing surface 72 may be changed from the shapes of these sections in the illustrated embodiment. For example, as viewed along the upper cross section, the outward-facing surface 66 may be recessed inward in the longitudinal direction of the associated lateral frame bar 50 between the corresponding two adjacent joint points P. Also, as long as the aforementioned condition is satisfied, the surface configuring each vibration reducing portion 60 may bulge between the corresponding two adjacent joint points P. For example, as viewed along the upper cross section, the inward-facing surface 72 may bulge inward in the longitudinal direction of the lateral frame bar 50 between the corresponding two adjacent joint points P. As long as each vibration reducing portion 60 satisfies the aforementioned condition, the vibration reducing portion 60 restrains vibration in the associated longitudinal frame bar 42 even after the shape of the vibration reducing portion 60 is changed.

As viewed along the perpendicular cross section, the cross-sectional area of each vibration reducing portion 60 does not necessarily have to be the smallest in the middle between the corresponding two adjacent joint points P. In other words, the cross-sectional area of the vibration reducing portion 60 may be the smallest at a position spaced from the middle between the corresponding two adjacent joint points P. The cross-sectional area of the vibration reducing portion 60 may become greater toward the middle between the corresponding two adjacent joint points P. However, the sections of the vibration reducing portion 60 in the vicinity of each of the joint points P need to have a sufficient strength for tolerating the fastening force of the corresponding bolt B. It is thus preferable to ensure a sufficient cross-sectional area in each section of the vibration reducing portion 60 in the vicinity of each joint point P.

Each vibration reducing portion 60 may be arranged only partially in the section between the corresponding two adjacent joint points P in the associated longitudinal frame bar 42. In some cases, boss portions for receiving bolts may project from the longitudinal frame bars in the camshaft housing. Also, such boss portions may have a basal end having a partially curved surface. In this case, only a narrow area is shaped as a curved surface. However, even in this case, the function of the vibration reducing portion 60 cannot be ensured. It is thus preferable to arrange the vibration reducing portions 60 each in an area larger than or equal to a quarter or a third of the area between the corresponding two adjacent joint points P.

If each vibration reducing portion 60 is arranged in a restricted area in the associated longitudinal frame bar 42 as in the above-described modification, the vibration reducing portion 60 may be either arranged continuously from one of the corresponding two adjacent joint points P or arranged in an area spaced from the joint points P. However, it is preferable to arrange the vibration reducing portions 60 each in the section of the longitudinal frame bar 42 in the middle between the corresponding two adjacent joint points P. Also, it is more preferable to arrange each vibration reducing portion 60 continuously from one of the corresponding two adjacent points P to the middle between the joint points P. Each section of each longitudinal frame bar 42 in the middle between any adjacent two of the joint points P may be an antinode of vibration. Therefore, by arranging each vibration reducing portion 60 in the middle between the corresponding two adjacent joint points P, the resonance in the section that is the antinode of vibration is effectively restrained. Further, the resonance of each longitudinal frame bar 42 is restrained with extreme effectiveness by arranging each vibration reducing portion 60 continuously from each of the corresponding two adjacent joint points P, which are nodes of vibration, to the middle section between the joint points P, which is an antinode of vibration.

The overhang F of each longitudinal frame bar 42 may be arranged only in a section in the longitudinal direction of the longitudinal frame bar 42. In some cases, the overhangs F may be omitted depending on how the camshaft housing 40 is fixed to another component, such as a head cover.

The number of lateral frame bars 50 may be changed as needed in correspondence with the number of cylinders in the cylinder block.

The positions and number of bolt holes 54 in each lateral frame bar 50 may be changed as needed. However, to ensure the effect of each vibration reducing portion 60 of the longitudinal frame bars 42 appropriately, the bolt holes 45 need to be arranged on the outer side of the bearing portions 52 in the longitudinal direction of the lateral frame bar 50.

The outer frame bar 44 may be omitted.

The configuration of the cylinder head body 20 may be changed as needed. For example, the number of combustion chambers 22 may be changed in correspondence with the number of cylinders in the cylinder block. The dimensions and shape of the mounting structure portion 25 may also be changed as needed. Further, the positions and number of boss portions 26 may be changed in correspondence with the positions and number of bolt holes 54 in the lateral frame bars 50 of the camshaft housing 40. In a case in which the positions of the boss portions 26 are changed, it is required that the boss portions 26 have sufficient strength for tolerating the fastening force produced by fastening the bolts B together with the camshaft housing 40 and the cam caps 30.

The shape and dimensions of each cam cap 30 may be changed as needed. However, the cam caps 30 need to have such shapes that the cam caps 30 can be fixed to the upper side of the camshaft housing 40 and are capable of rotationally supporting the camshafts 100 between the cam caps 30 and the lateral frame bars 50.

The cylinder head body 20, the camshaft housing 40, and the cam caps 30 may be made of materials different from one another. Alternatively, only one of these types of components may be made of a different material and the other two types of the components may be made of the same material.

The liquid gasket arranged between the camshaft housing 40 and the cylinder head body 20 may be replaced by a metal gasket. To improve the sealing performance between the camshaft housing 40 and the cylinder head body 20, employing a liquid gasket is preferable.

The invention claimed is:

1. A cylinder head comprising:

a cylinder head body fixed to an upper surface of a cylinder block; and a camshaft housing fixed to an upper surface of the cylinder head body, wherein a camshaft is accommodated in the camshaft housing, the camshaft housing includes two longitudinal frame bars, which extend in an axial direction of the camshaft, and a plurality of lateral frame bars, which extend between the longitudinal frame bars, a bearing portion is arranged in an upper surface of each of the lateral frame bars to rotationally support the camshaft, each of the bearing portions is a portion recessed from the upper surface of one of the lateral frame bars, a bolt hole is provided in each lateral frame bar to receive a bolt that is inserted through the bolt hole to fix the camshaft housing to the cylinder head body, each of the bolt holes extends through one of the lateral frame bars and is arranged on an outer side of the corresponding bearing portion in a longitudinal direction of the lateral frame bar, the longitudinal frame bars each have a plurality of joint points at which the longitudinal frame bar is joined to the corresponding lateral frame bar, each longitudinal frame bar includes, between adjacent two of the joint points, a vibration reducing portion, wherein a cross-sectional area of a cross section of the vibration reducing portion that is perpendicular to a longitudinal direction of the longitudinal frame bar gradually changes in the longitudinal direction of the longitudinal frame bar, the vibration reducing portion includes an outer upper surface, an arcuate inner upper surface extending from an inner edge of the outer upper surface in the longitudinal direction of the lateral frame bar, an inward-facing surface extending downward from a lower edge of the arcuate inner upper surface and facing inward in the longitudinal direction of the lateral frame bar, a lower surface extending from a lower edge of the inward-facing surface toward an outer side in the longitudinal direction of the lateral frame bar, and an outward-facing surface extending from an edge of the lower surface on the outer side in the longitudinal direction of the lateral frame bar, the arcuate inner upper surface becomes curved more downward toward a middle between the two adjacent joint points such that the lower edge of the arcuate inner upper surface at the middle between the two adjacent joint points is lower than at either of the two adjacent joint points, and the arcuate inner upper surface becomes more recessed more outward in the longitudinal direction of the lateral frame bar toward the middle between the two adjacent joint points such that the lower edge of the arcuate inner upper surface is closer to the outward-facing surface at the middle between the two adjacent joint points than at either of the two adjacent joint points.

2. The cylinder head according to claim 1, wherein the vibration reducing portion is arranged continuously from at least one of the adjacent two of the joint points to a middle between the two adjacent joint points.

3. The cylinder head according to claim 1, wherein the vibration reducing portion is arranged over an entire area between the two adjacent joint points, the vibration reducing portion has a perpendicular cross section perpendicular to the longitudinal frame bar, and a cross-sectional area of the perpendicular cross section is the smallest in the middle between the two adjacent joint points.

4. The cylinder head according to claim 3, wherein a material of the camshaft housing is the same as a material of the cylinder head body, and a liquid gasket is arranged between the camshaft housing and the cylinder head body.

5. The cylinder head according to claim 1, wherein an upper end section of each longitudinal frame bar includes an outwardly extended, flange-shaped overhang, the outer upper surface of the vibration reducing portion configures an upper surface of the overhang, and an upper end section of the outward-facing surface of the vibration reducing portion configures an outer side surface of the overhang.

* * * * *